US005143359A

United States Patent [19]

Bush

[11] Patent Number: 5,143,359

[45] Date of Patent: Sep. 1, 1992

[54] SWIVEL CLAMP GUARD

[76] Inventor: Matthew A. Bush, 244 Wynnfield Dr., Syracuse, N.Y. 13214

[21] Appl. No.: 699,369

[22] Filed: May 13, 1991

[51] Int. Cl.[5] ..... B25B 1/00

[52] U.S. Cl. ..... 269/6; 269/261; 269/283; 269/286; 81/423; 81/424; 403/348; 403/121

[58] Field of Search ..... 269/3, 6, 249, 271, 269/279, 283, 284, 277, 274, 273, 286, 261; 81/421, 422, 423, 424; 403/348, 121

[56] References Cited

U.S. PATENT DOCUMENTS

| | | | |
|---|---|---|---|
| 929,868 | 8/1909 | Mueller | 81/423 |
| 2,766,649 | 10/1956 | Labry | 269/274 |
| 3,984,092 | 10/1976 | Fitzpatrick | 81/422 |
| 4,315,447 | 2/1982 | Tartaglia et al. | 81/421 |
| 4,459,785 | 7/1984 | Zimmer | 403/348 |
| 4,583,671 | 4/1986 | Cressy | 81/421 |

FOREIGN PATENT DOCUMENTS

| | | | |
|---|---|---|---|
| 2157203 | 10/1985 | United Kingdom | 269/283 |

*Primary Examiner*—Bruce M. Kisliuk
*Assistant Examiner*—Eileen Morgan
*Attorney, Agent, or Firm*—Wall and Roehrig

[57] ABSTRACT

A plastic protective gripping member or guard fits on the jaw of a Vise-Grip type locking wrench whose jaws have lateral protuberances at their tips. The gripping member can be in a form of a block or cup having a slot with internal recesses on each side wall. The gripping member fits onto the jaw and permits swiveling about a transverse axis. The gripping member is installed by pushing it onto the jaw tip and twisting it 90 degrees. Nylon is a perferred material because of its comparatively high coefficient of friction even when wet or oily. The gripping surface can be concave, ridged, or flat.

10 Claims, 2 Drawing Sheets

SWIVEL CLAMP GUARD

BACKGROUND OF THE INVENTION

This invention relates to jaw type clamps, and is more particularly related to a guard or protective member that can be removably fitted onto one jaw of a clamp, especially of the Vise-Grip C-clamp locking pliers.

A number of C-jaw or L-jaw clamps are available in the form of locking pliers. If these are applied directly to wooden workpieces, the steel jaw tip can mar or crack the workpiece. A number of adaptive gripping members have been earlier proposed, such as in Fitzpatrick U.S. Pat. No. 3,984,092, which shows a table or anvil permanently attached to one jaw by means of a pivot pin. There are other specialized members available for a variety of purpose. For example, a slide-on jaw attachment for a pliers type clamping grip wrench is described in Cressy U.S. Pat. No. 4,583,671, and a rubber insert for a pliers jaw is described in Tartaglia et al. U.S. Pat. No. 4,315,447. However, no one has previously proposed or suggested a removably attachable member that can assist in gripping the workpiece and also protect the workpiece from damage by the jaw during clamping.

OBJECTS AND SUMMARY OF THE INVENTION:

It is an object of this invention to provide a guard or cushion that fits on the jaw of the locking pliers wrench.

It is another object of this invention to provide a gripping member that removably fits on the clamping jaw and is arranged to stay parallel to the workpiece as the jaws close.

It is another object of this invention to provide the gripping member with a comparatively high coefficient of friction.

It is a still further object of this invention to provide a gripping member of simple design which can be readily and economically fabricated from available synthetic resin materials.

According to one aspect of this invention, the protective gripping member comprises a block of a synthetic resin material in which there is a distal gripping surface and a slot with an opening at the proximal side of the block to receive the distal tip of an arm of the clamp jaw. The slot is provided with internal recesses on opposite side walls, and these internal recesses receive the lateral protuberances that project transversely from the jaw tip. The gripping member is installed by placing it onto the distal tip, with the latter being interposed in the slot, and then by rotating the gripping member to lodge the recesses onto the protuberances.

Preferably, at least the distal portion of the block is formed of a synthetic resin material that has a high coefficient of friction. Here, nylon or polyamide is preferred because it has a high coefficient of friction (0.4). Nylon maintains this comparatively high coefficient of friction even when wet or oily. The gripping surface need not be flat, but can be concave or even ridged. In some embodiments, the gripping member can be in two parts, with an interchangeable distal gripping portion.

The above and many other objects, features, and advantages of this invention will be more fully understood from the ensuing description of a few selected embodiments, which should be read in connection with the accompanying Drawing.

Figure 1:
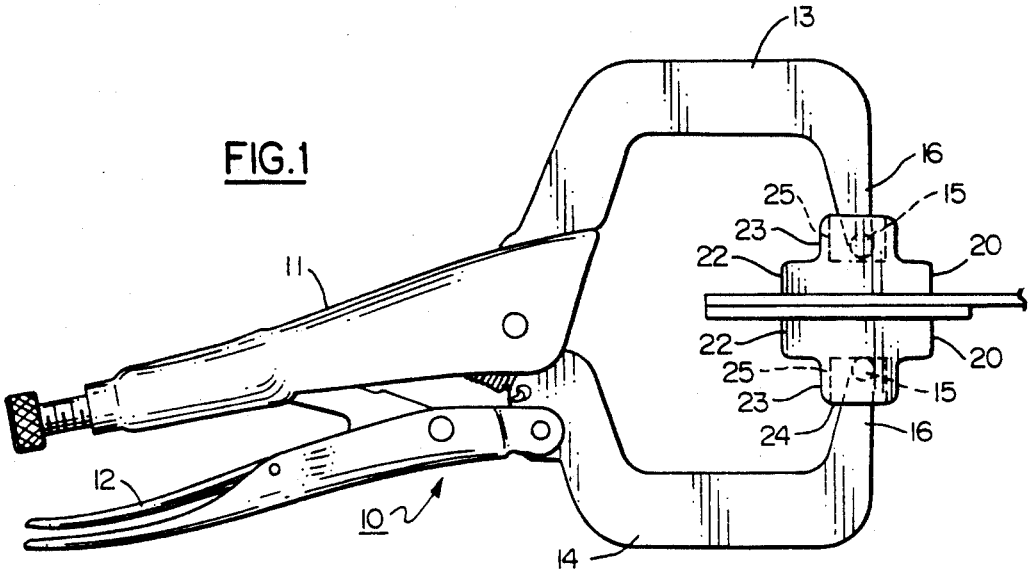
FIG. 1 is a perspective view showing a toggle type C-jaw clamping pliers, on which are employed gripping members according to an embodiment of this invention.
Figure 2:
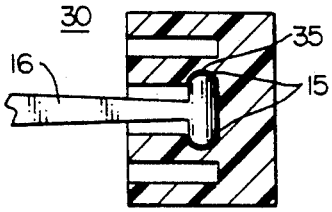
FIGS. 2 and 3 are sectional views taken along lines 2—2 and 3—3 of FIG. 5.
Figure 3:
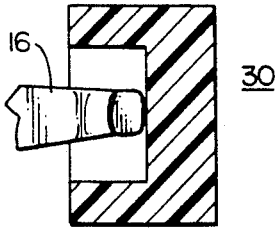
Figure 4:
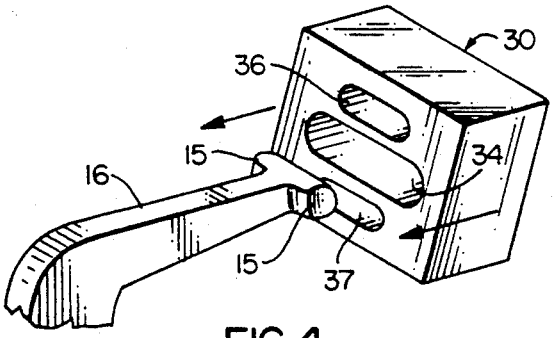
FIGS. 4 and 5 are perspective views showing the installation of a gripping member of this invention onto the distal end of a clamping jaw.

DETAILED DESCRIPTION OF THE PREFERRED EMBODIMENTS:

With reference now to the Drawing, FIG. 1 shows a C-jaw type clamping toggle pliers 10, having a handle portion 11 including a release lever 12, a C-shaped upper jaw 13, and a C-shaped lower jaw 14. The jaws 13, 14, each have a pair of transverse projections 15 at the distal tip of the respective jaw arms 16. This structure is also shown in FIG. 4.

A pair of swivel clamp guards 20 are provided, one on each of the jaw arms 16, and a workpiece 21 in the form of a pair sheets is shown clamped together for gluing. The workpiece 21 is clamped between the swivel guards 20.

Each of these guards 20 has a distal portion 22 with a front surface that presses against the workpiece 21 and a proximal portion 23 which has a slot 24 to receive the distal tip of the clamping arm 16. There are internal recesses 25 in the side walls of the slot 24. The oppositely directed projections 15 seat into these recesses. The clamping guards 20 pivot about the axis defined by the transverse projections 15. As a result, the face of the distal portion 22 pivots or swivels to stay parallel to the workpiece as the clamping jaws 13 and 14 close together.

Another embodiment of the protective gripping member of this invention is shown in FIGS. 2–5. Here the gripping member is in the form of a generally rectangular block 30 of a suitable plastic resin. Again, for its high coefficient of friction, nylon is highly suited as the plastic resin material. However, other plastic resins, such as polyethylene, could be employed because of their ease of molding and low cost. In this case, the gripping member has a flat distal gripping surface and a slot 34 opening out its proximal surface to receive the tip of the jaw arm 16 of the clamping pliers. As with the previous embodiment, there are internal recesses 35 on opposite side walls of the slot 34 to receive the transverse projections 15 of the jaw arm 16. In order to relieve some of the lateral stiffness in the material and to facilitate flexing of the walls of the slot 34, there are auxiliary slots 36 and 37 formed in the block parallel to the slot 34.

Figure 5:
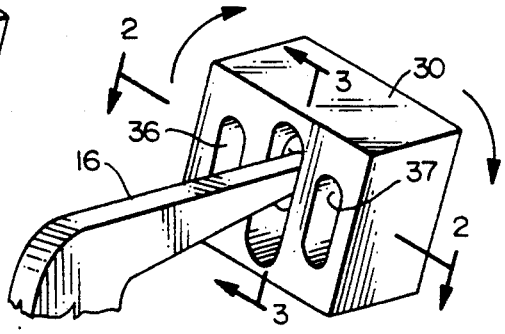

The gripping member 30 is installed as shown in FIGS. 4 and 5. The block is pushed onto the jaw arm 16 with the tip entering the slot 34. Then, the block 30 is twisted ninety degrees (FIG. 5) so that the two transverse projections 15 on the jaw arm lodge in the recesses 35. To remove the swivel guard, the steps are reversed.

Again, because the projections 15 serve as a swiveling axis, the block can pivot about that axis so that its gripping face remains parallel to the workpiece.

The design of this embodiment provides additional backing or support at the edges, as may be required in some heavy duty applications.

Figure 6:
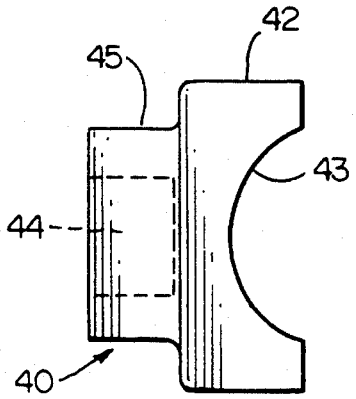
FIGS. 6 and 7 are a side view and a perspective view respectively of a gripping member according to another embodiment of this invention.
Figure 7:
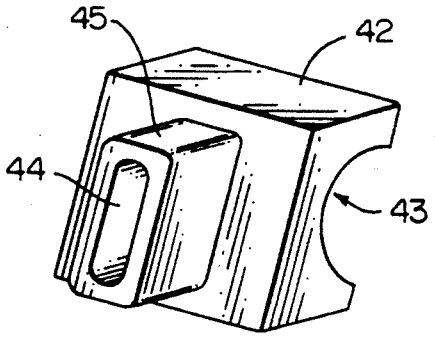

A further embodiment is shown in FIGS. 6 and 7 in which a gripping member 40 has a distal portion 42 with a curved gripping face 43. Here, the face 43 has a concave cylindrical shape suitable for gripping tubing or dowels. As in the other embodiments, there is a slot 44 on the proximal portion to receive the tip of the jaw arm 16 of a clamping pliers. In this embodiment, the proximal portion 45 is of reduced thickness laterally, so that there are thin walls in the vicinity of the slot 44. This permits flexing to facilitate installation or removal of the gripping member 40.

Figure 8:
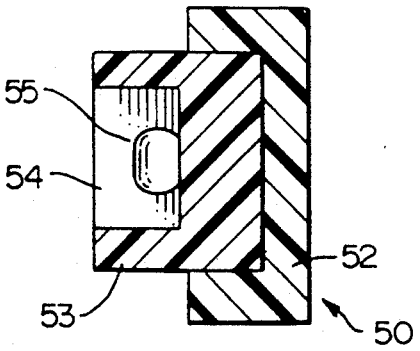
FIGS. 8 and 9 are a sectional elevation and a perspective view of a two-part gripping member according to an embodiment of this invention.
Figure 9:
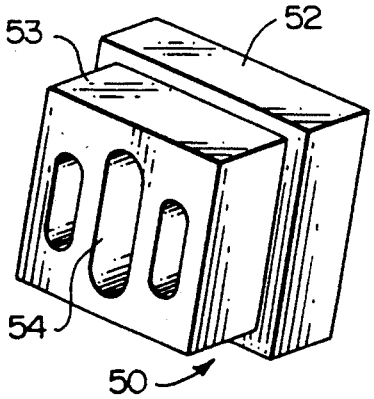

Yet another embodiment of this invention is shown in Figs. 8 and 9. Here, a gripping member 50 is formed as a two-piece member, in which a distal portion 52 is formed of a high friction polymer such as nylon or polyamide, and distinct proximal portion 53 is formed of a flexible but durable material such as HDPE or the like. The latter has the further advantage that it is easy to mold and is quite inexpensive.

The proximal portion 53 has slots 54 similar to those of the embodiment of FIGS. 2–5. The proximal portion has a recess 55 which permits a friction over the proximal portion 53. This arrangement as shown has the advantage not only that two separate materials can be employed in combination, but also that the distal portions 52 can be interchanged with other such members, for example, with curved or grooved faces or with greater breadth or thickness as may be required for a particular application.

Figure 10:
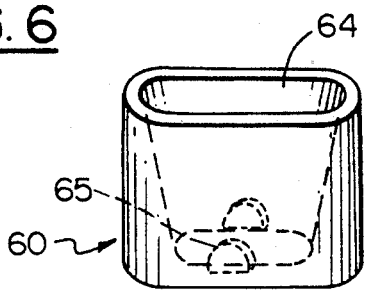
FIG. 10 is a perspective view of a gripping member according to another embodiment of this invention.

A still further embodiment is shown in FIG. 10, in which the gripping member is in the form of a cup 60 having a tapered-wall slot 64 with internal recesses 65. This particular design can be employed especially with smaller workpieces or where less surface area is required for gripping.

While this invention has been described in detail with respect to certain preferred embodiments, it should be understood that this invention is not limited to those precise embodiments. Rather, many modifications and variations would present themselves to those of skill in the art without departing from the scope and spirit of this invention, as defined in the appended claims.

What is claimed is:

1. A protective gripping member for a gripping clamp of the type that has at least one generally C-shaped or L-shaped jaw having a jaw arm with lateral protuberances at its distal tip, the gripping member removably fitting onto said distal tip and pivoting about a transverse axis formed by said protuberances, the gripping member comprising a block of a synthetic resin material having a distal gripping surface and a slot with an opening at a proximal side of the block to receive said distal tip of the jaw arm, the slot being provided with recess means formed as disposed internal recesses on opposite side walls thereof to receive said lateral protuberances, such that said gripping member is installed by placing it onto said distal tip with the latter in the slot and then rotating the gripping member to lodge said recesses onto said protuberances.

2. The gripping member of claim 1 wherein at least a distal portion of said block is formed of a synthetic resin material having a high coefficient of friction.

3. The gripping member of claim 2 wherein said synthetic resin material is nylon.

4. The gripping member of claim 1 wherein said distal gripping surface is flat.

5. The gripping member of claim 1 wherein said distal gripping surface is generally cylindrical.

6. The gripping member of claim 1 wherein said block is formed as a cup having said slot defining side walls of the cup, and with the internal recesses being formed on opposite side walls of the cup.

7. The gripping member of claim 6 wherein aid cup side walls are tapered, so as to be thicker distally.

8. A protective gripping member for a gripping clamp of the type that has at least one generally C-shaped or L-shaped jaw having a jaw arm with lateral protuberances at its distal tip, the gripping member removably fitting onto said distal tip and pivoting about a transverse axis formed by said protuberances, the gripping member comprising a block of a synthetic resin material having a distal gripping surface and a slot with an opening at a proximal side of the block to receive said distal tip of the jaw arm, the slot being provided with internal recesses on opposite side walls thereof to receive said lateral protuberances, such that said gripping member is installed by placing it onto said distal tip with the latter in the sot and then rotating the gripping member to lodge said recesses onto said protuberances, wherein said block is formed in two portions with a distal portion thereof being formed of a high-friction-coefficient synthetic resin and a proximal portion containing said slot and internal recesses being formed of a low-friction-coefficient synthetic resin.

9. The gripping member of claim 8 wherein said distal portion is removably friction fitted onto said proximal portion to permit interchangeability of distal portions of various shapes.

10. A protective gripping member for a gripping clamp of the type that has at least one generally C-shaped or L-shaped jaw having a jaw arm with lateral protuberances at its distal tip, the gripping member removably fitting onto said distal tip and pivoting about a transverse axis formed by said protuberances, the gripping member comprising a block of a synthetic resin material having a distal gripping surface and a slot with an opening at a proximal side of the block to receive said distal tip of the jaw arm, the slot being provided with internal recesses on opposite side walls thereof to receive said lateral protuberances, such that said gripping member is installed by placing it onto said distal tip with the latter in the slot and then rotating the gripping member to lodge said recesses onto said protuberances, and further comprising additional slots parallel to the first-mentioned slot to permit flexing of the side walls of the first-mentioned slot and to facilitate installing of the lateral protuberances of the jaw distal tip into the internal recesses.

* * * * *